US006824332B2

(12) United States Patent
Root

(10) Patent No.: US 6,824,332 B2
(45) Date of Patent: Nov. 30, 2004

(54) SILT FENCE FLAT PACK AND PRODUCTION METHOD

(76) Inventor: Melvin Robert Root, P.O. Box 681, Shady Grove, FL (US) 32357

( * ) Notice: Subject to any disclaimer, the term of this patent is extended or adjusted under 35 U.S.C. 154(b) by 498 days.

(21) Appl. No.: 09/822,492

(22) Filed: Apr. 2, 2001

(65) Prior Publication Data

US 2002/0141830 A1 Oct. 3, 2002

(51) Int. Cl.[7] ..... E01F 7/00

(52) U.S. Cl. ..... 405/302.7; 405/302.6; 405/15; 256/12.5

(58) Field of Search ..... 405/302.7, 302.6, 405/302.4, 258.1, 15, 21, 32, 35; 256/12.5; 135/95, 902, 143, 126, 97

(56) References Cited

U.S. PATENT DOCUMENTS 4,606,070 A * 8/1986 Schachter ..... 135/95
4,756,511 A * 7/1988 Wright, III ..... 256/12.5
4,969,500 A * 11/1990 Makosa ..... 135/902
5,029,819 A * 7/1991 Kane ..... 256/12.5
5,039,250 A * 8/1991 Janz ..... 405/302.6
5,054,507 A * 10/1991 Sparks ..... 135/97
5,865,355 A * 2/1999 Camara ..... 135/143
5,937,883 A * 8/1999 Camara ..... 135/97
6,053,665 A * 4/2000 Richardson ..... 405/302.6
6,092,792 A * 7/2000 Camara ..... 135/87
6,142,704 A * 11/2000 Coyne ..... 405/21
6,158,923 A * 12/2000 Wheeler et al. ..... 405/302.6

* cited by examiner

*Primary Examiner*—Frederick L. Lagman
(74) *Attorney, Agent, or Firm*—J. Wiley Horton

(57) ABSTRACT

A method for packaging conventional silt fencing and a product produced by the method. Silt fabric is attached to a number of evenly spaced stakes. The stakes are then bunched together so that the silt fabric hangs between the stakes in descending loops. The bunching is continued until all the stakes lie close together in one plane. The loops of silt fabric are then wrapped tightly around the stakes. Securing bands are then placed around the assembly to create a flat pack.

8 Claims, 9 Drawing Sheets

SILT FENCE FLAT PACK AND PRODUCTION METHOD

CROSS-REFERENCES TO RELATED APPLICATIONS

Not Applicable

STATEMENT REGARDING FEDERALLY SPONSORED RESEARCH OR DEVELOPMENT

Not Applicable

MICROFICHE APPENDIX

Not Applicable

BACKGROUND OF THE INVENTION

1. Field of the Invention

This invention relates to the field of soil erosion control. More specifically, the invention comprises a new method of manufacturing and packing sections of silt fence.

2. Description of the Related Art

Soil erosion is a constant problem in construction work, where the bare soil must often be left exposed to rain for considerable periods. Traditionally, hay bails were staked to the ground in order to slow water run-off down bare slopes. While effective, this technique was labor intensive and had inherent shipping and storage problems—owing to the weight of the bales. The more modem approach is to use silt fencing.

A silt fence is a porous barrier fabric which is attached to and stretched between a number of stakes. The stakes are driven into the ground in positions needed to stretch the fabric across the anticipated direction of water flow. The fabric is designed to allow the passage of water, but to encourage the deposition of any sediment being carried in the water. The result is that sediment builds up on the upstream side of the fabric, with the silt fence ultimately tending to bury itself.

Numerous prior art patents pertain to silt fences and methods of producing and installing them. These prior art patent include U.S. Pat. Nos. 6,158,923, 6,053,665, 5,944,114, 5,921,709, 5,915,878, 5,622,448, 5,345,741, and 4,756,511.

FIG. 1 illustrates a typical prior art silt fence. A plurality of evenly spaced stakes 12 are provided. Silt fabric 10 is placed over stakes 12, then affixed to stakes 12 by staples or other fastening means. The user places the fence in position by driving points 16 of stakes 12 into the ground, with the lower portion of silt fabric 10 being buried in a shallow trench.

While FIG. 1 illustrates the components of a silt fence, it does not accurately reflect how such fences are typically manufactured. FIG. 2 shows roll 28, which is formed by a plurality of stakes 12 attached to silt fabric 10. A silt fence is typically made by chucking center stake 36 in a rotating carriage, then attaching the starting end of silt fabric 10 to it. Center stake 36 is then rotated to wind silt fabric 10 around itself. At fixed intervals, another stake 12 is brought in and stapled to silt fabric 10. The winding continues until a complete roll 28 is formed. It is then taped, tied, or banded to lock it in position for transportation and storage.

FIG. 2 illustrates roll 28 having eight stakes 12. Roll 28 can be made larger or smaller. Those skilled in the art will realize that the prior art manufacturing process described is an intermittent one; i.e., once a roll is formed, the process is stopped to remove that roll and start forming a new one. This represents a disadvantage, in that it limits the speed of production. It also causes problems with any printing performed on silt fabric 10. Many purchasers want to have their names and logos printed on the silt fabric itself The best printing methods for this purpose are those using a wet printing plate. The printing dyes employed are dissolved in a liquid carrier, which must be quite volatile (in order for the printing to dry rapidly). Thus, the wet printing process is very sensitive to any pauses in the production. If the feed of silt fabric 10 is halted for significant periods, the dye solutions will dry on the printing plate and the print quality will deteriorate. The prior art intermittent production process therefore compromises printing quality on silt fabric 10.

The roll method has two additional drawbacks. First, rolls 28 do not stack efficiently, since their circular cross section inherently produces wasted space. Second, roll 28 is cumbersome to install. Those skilled in the art will realize that roll 28—as illustrated in FIG. 2—is modestly sized. Often these rolls will be 100 feet long. A typical installation would be in the range of 100 feet to 10,000 feet long. It is very cumbersome to unroll many hundreds of feet of silt fencing packaged in the roll form.

It is also fairly common to need a length which is less than the entire roll. In such a case, the user must lift roll 28 by its ends and unroll the needed amount. The user then cuts the needed amount free from the rest of the roll. As roll 28 can be heavy, this approach often means that two people are needed.

Alternatively, the user can unroll roll 28 by rolling it along the ground until the needed amount is laid flat. The user then removes the needed amount and re-rolls roll 28. This approach requires the user to lift a heavy object (roll 28) off the back of a truck, perform the operation, and then lift it back on to the truck.

Accordingly, the prior art methods of packing silt fencing are limited in that they:

1. Typically require an intermittent manufacturing process, thereby limiting production speed and compromising print quality;
2. Do not lend themselves to efficient packing; and
3. Render the silt fence cumbersome to deploy.

BRIEF SUMMARY OF THE INVENTION

The present invention eliminates the disadvantages inherent in the prior art by placing the silt fence in a flat-pack configuration. With reference to FIG. 4, stakes 12 are evenly spaced and silt fabric 10 is evenly draped over them by any suitable means to form a series of loops 14. Silt fabric 10 is then attached to each stake 12 at the point where it drapes over each stake 12.

Stakes 12 are then moved closer to each other as shown in FIG. 6, with the result that loops 14 grow longer and more narrow. FIG. 7 shows stakes 12 bunched tightly together, with the result that loops 14 are now very long and very narrow. As stakes 12 are held in position, loops 14 are then wrapped around stakes 12 as indicated by the arrow.

FIG. 8 shows stakes 12—still being held in position—with loops 14 wrapped around them. In FIG. 9, securing straps 24 have been placed around the assembly to create flat pack 26. This entire process can be carried out on a linear assembly line without intermittently stopping the motion.

The objects and advantages of the present invention are:

1. To provide an improved method of packing and storing silt fence which can be carried out on a linear assembly line without intermittently stopping the linear motion;

2. To provide an improved method of packing and storing silt fence which does not waste storage space; and
3. To provide an improved method of packing and storing silt fence which enables the user to easily pull off a short section of silt fence without having to lift the entire pack.

REFERENCE NUMERALS IN THE DRAWINGS

Figure 1:
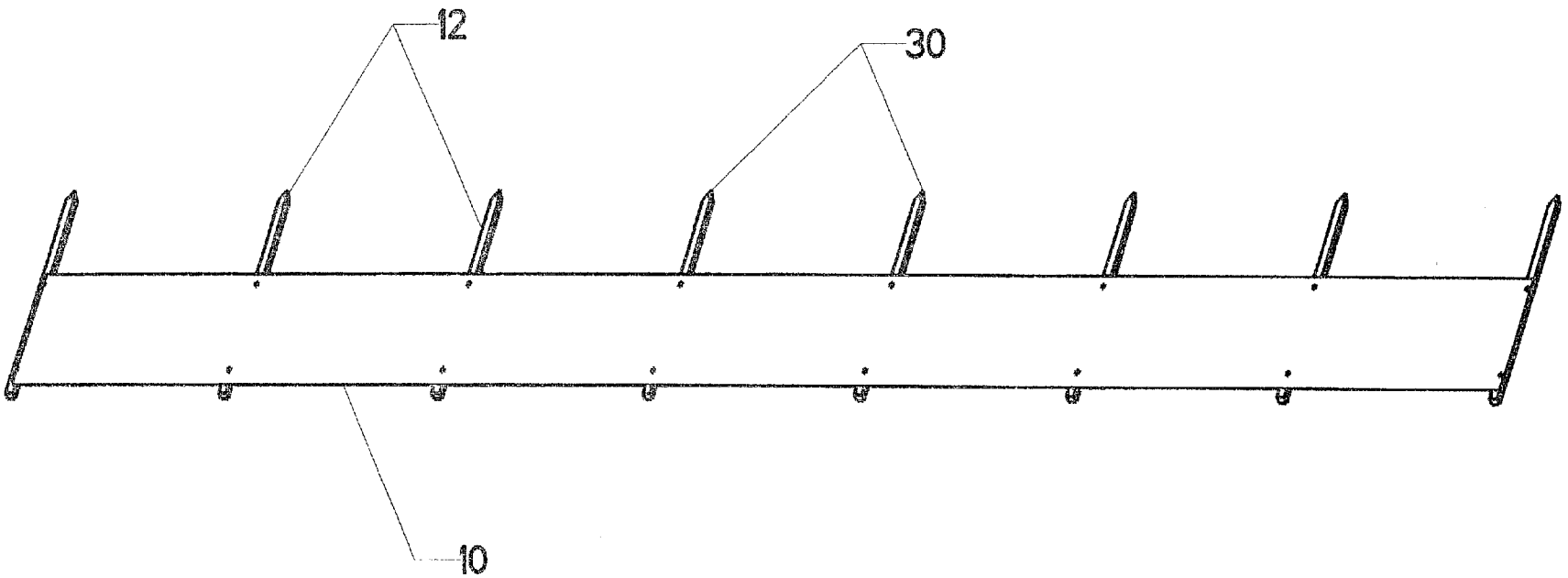
FIG. 1 (PRIOR ART)
FIG. 1 is an isometric view, showing a completed silt fence.
Figure 2:
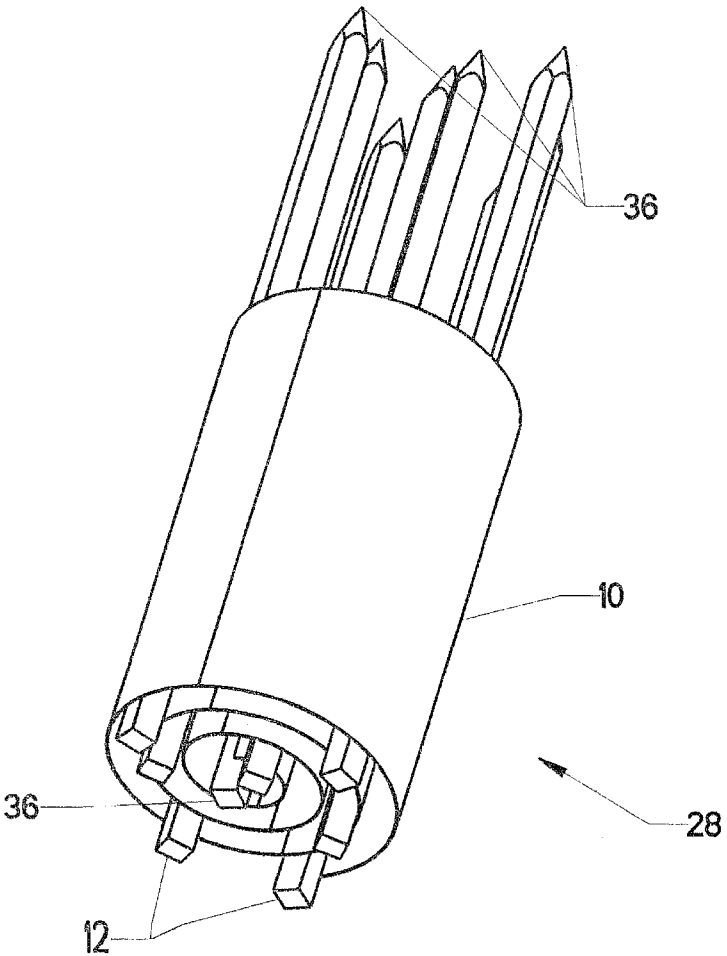
FIG. 2 (PRIOR ART)
FIG. 2 is an isometric view, showing the prior art method.

10 silt fabric
12 stake
14 loop
16 staple
18 stake top
20 starting color patch
22 ending color patch
24 securing strap
26 flat pack
28 roll
30 point
32 first stake
34 last stake
36 center stake

DETAILED DESCRIPTION OF THE INVENTION

Figure 3:
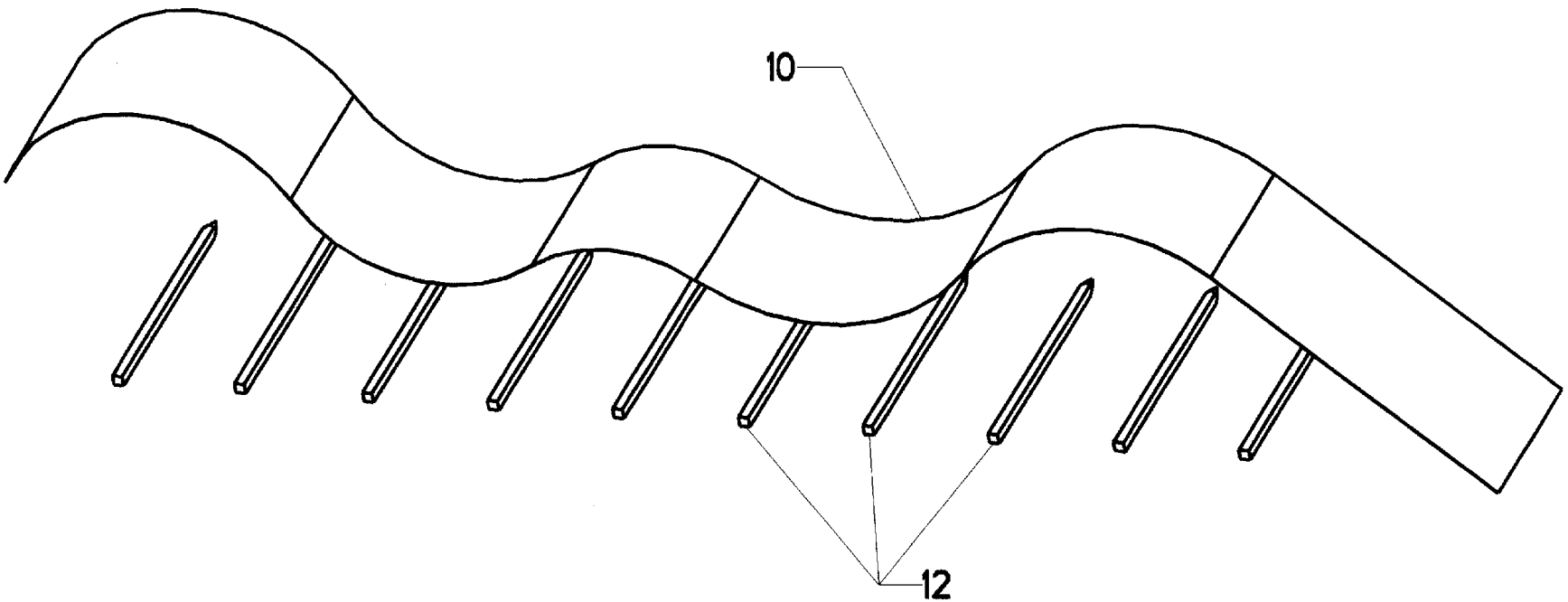
FIG. 3 is an isometric view, showing the manufacture of the present invention.

FIG. 3 illustrates the major components involved in the process. A plurality of stakes 12 are evenly spaced along a production line by any conventional means. A strip of silt fabric 10 is then fed to the top of the plurality of stakes 12. The illustration simply shows a long ribbon of silt fabric 10 being draped over stakes 12. This can also be accomplished by a linear feed of silt fabric 10 (such as off a large master roll) descending down over a line of moving stakes 12. In the example shown in FIG. 3, an assembly line could move stakes 12 from right to left in the view, as the ribbon of silt fabric 10 is deposited over their tops.

Figure 4:
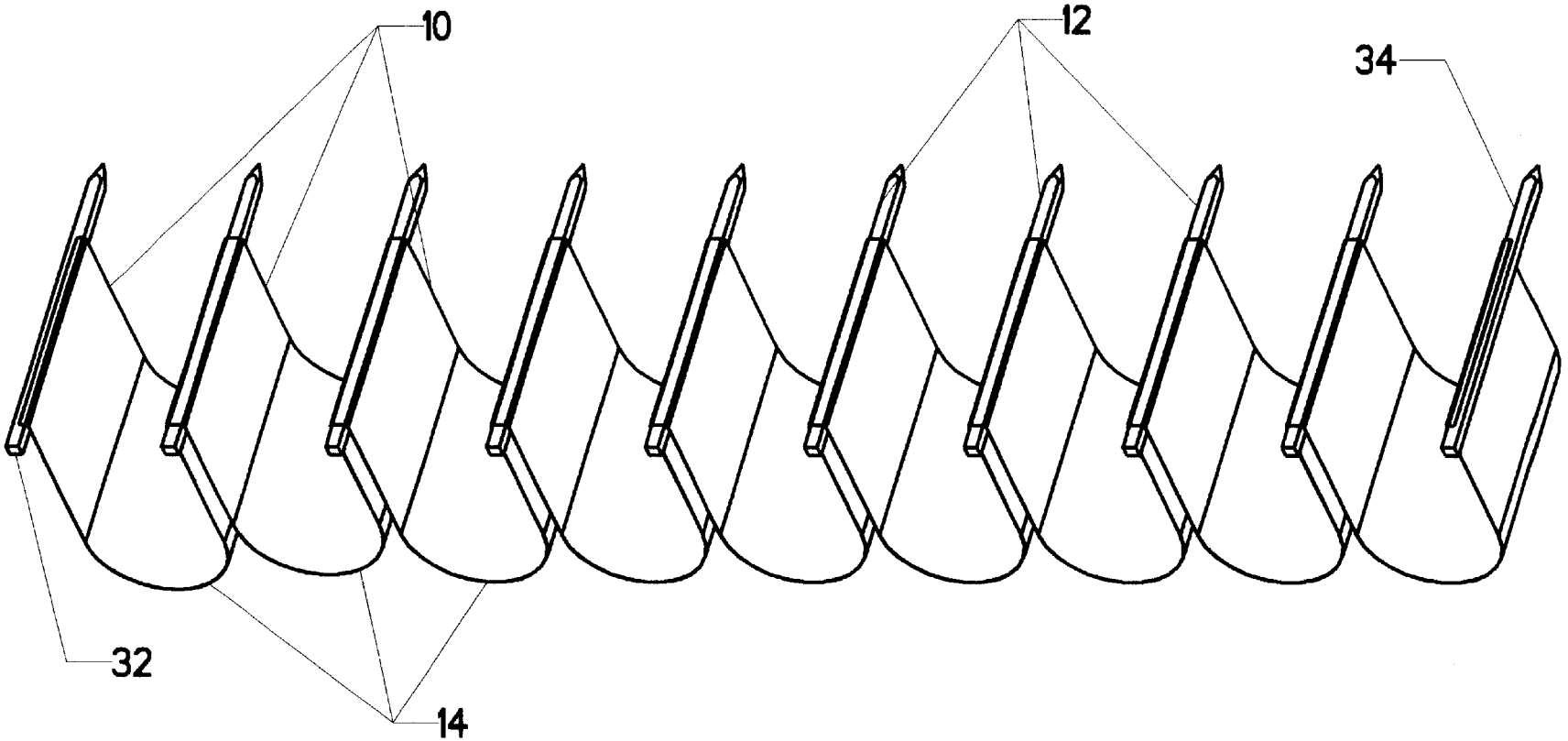
FIG. 4 is an isometric view, showing the manufacture of the present invention.

FIG. 4 shows silt fabric 10 laid evenly over stakes 12. However this operation is carried out, significant result is that silt fabric 10 must be placed so as to create a plurality of even loops 14 between stakes 12. The loops need not be exactly alike, but it is important to have them approximately equal in length.

Figure 5:
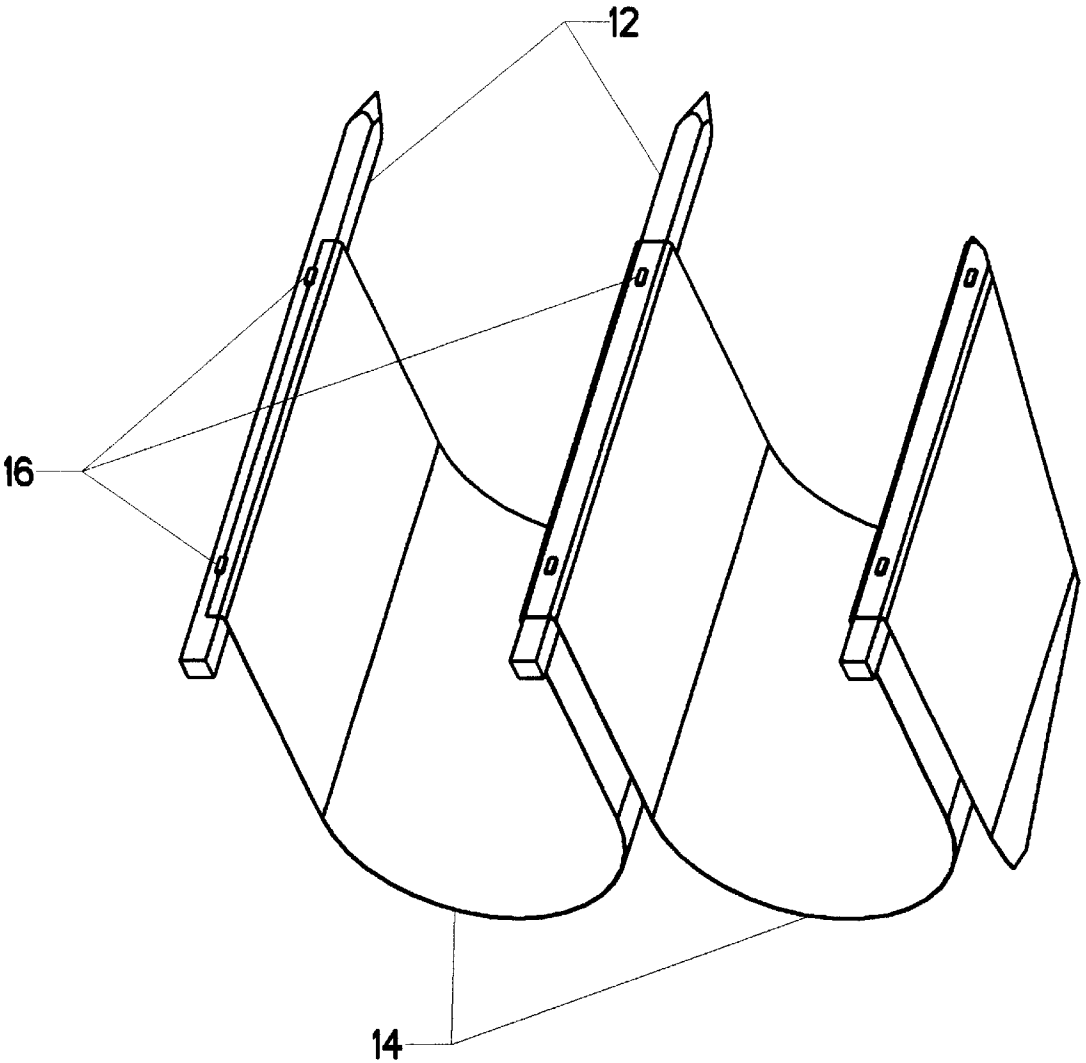
FIG. 5 is an isometric view, showing the addition of staples.

While stakes 12 and silt fabric 10 are in the relationship shown in FIG. 4, silt fabric 10 must be attached to stakes 12. FIG. 5—a detail view—shows the addition of stapes 16. Two or more staples 16 are driven through each portion of silt fabric 10 that lies on top of a stake 12. Once staples 16 are in place, the length of each loop 14 is fixed.

The reader should appreciate that while staples are particularly effective from a strength and cost standpoint, many other types of fasteners could be used. These would include nails, screws, adhesives, stitching, slats, tie cords, and the like.

Figure 6:
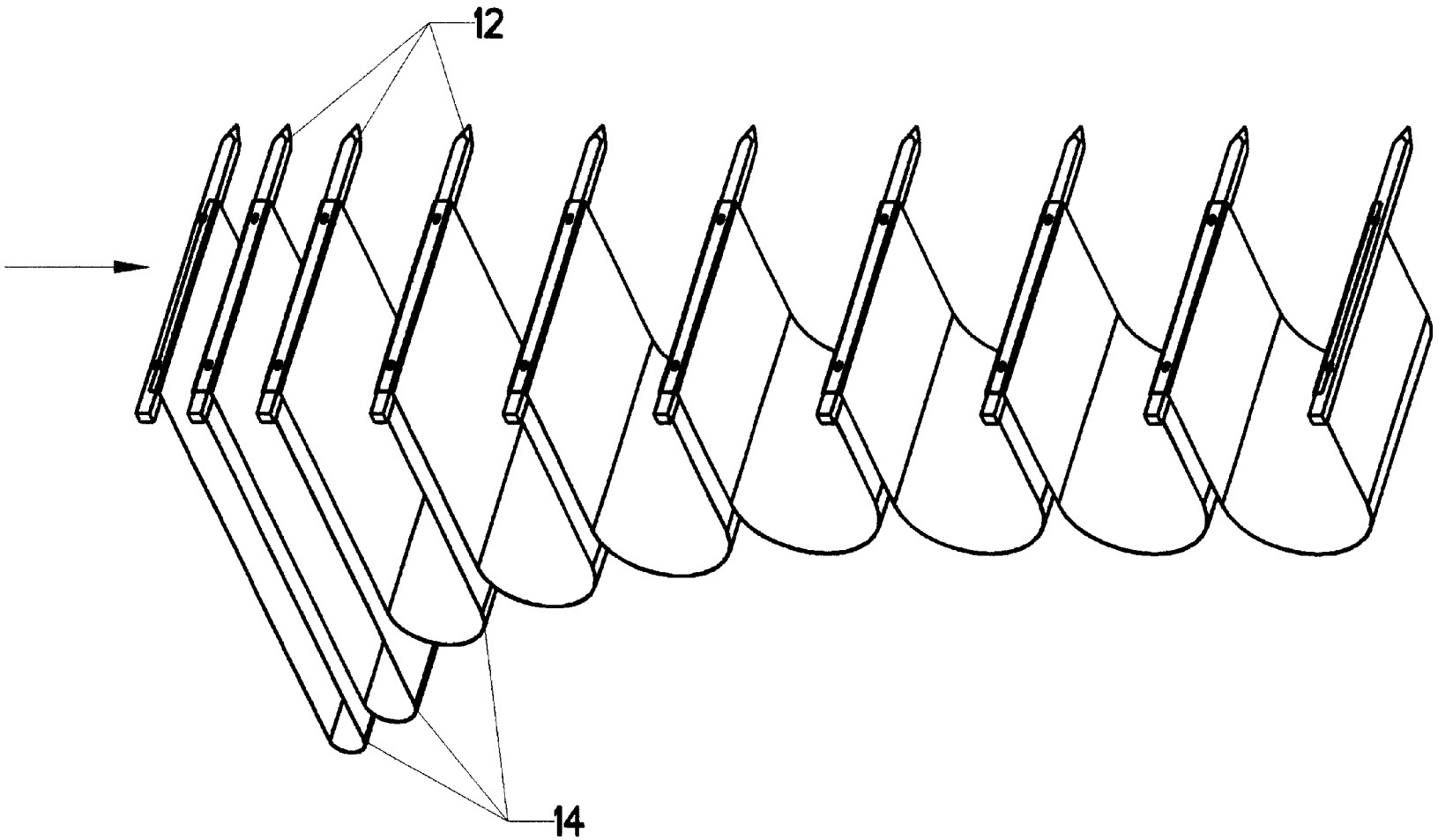
FIG. 6 is an isometric view, showing the bunching of the loops.
Figure 7:
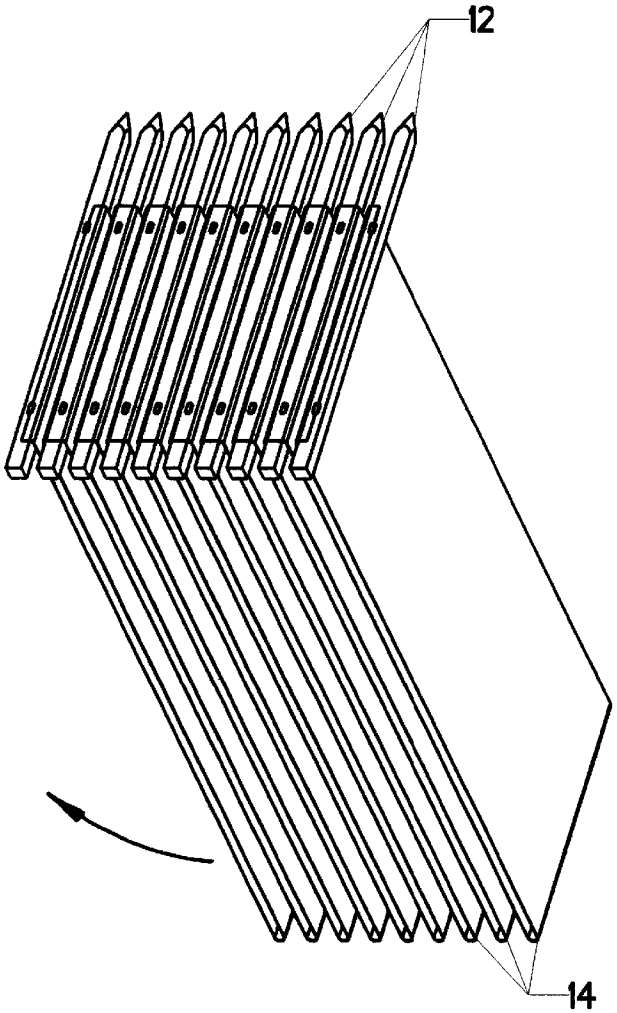
FIG. 7 is an isometric view, showing the completion of the bunching of the loops.

The next step in the manufacturing process is shown in FIG. 6. After staples 16 are in place, stakes 12 are pushed closer together—as shown by the arrow. The result is that loops 14 begin to lengthen and become more narrow. This process continues until stakes 12 are bunched closely together in a single plane, as shown in FIG. 7. The reader will note that loops 14 are by this point long and narrow. It is advantageous to use gravity to orient loops 14 by allowing them to descend below the production line during this process. However, the use of gravity is not the only way to accomplish this. A set of guiding rods placed through each loop 14 could be used to pull them in any direction desired. Many other conventional mechanisms could be employed.

Once the bunching of stakes 12 is complete, the plurality of loops 14 is wrapped around stakes 12 in the direction indicated by the arrow. Stakes 12 are held in position as loops 14 are wrapped snugly around them. This wrapping process serves to pull stakes 12 even closer together.

Figure 8:
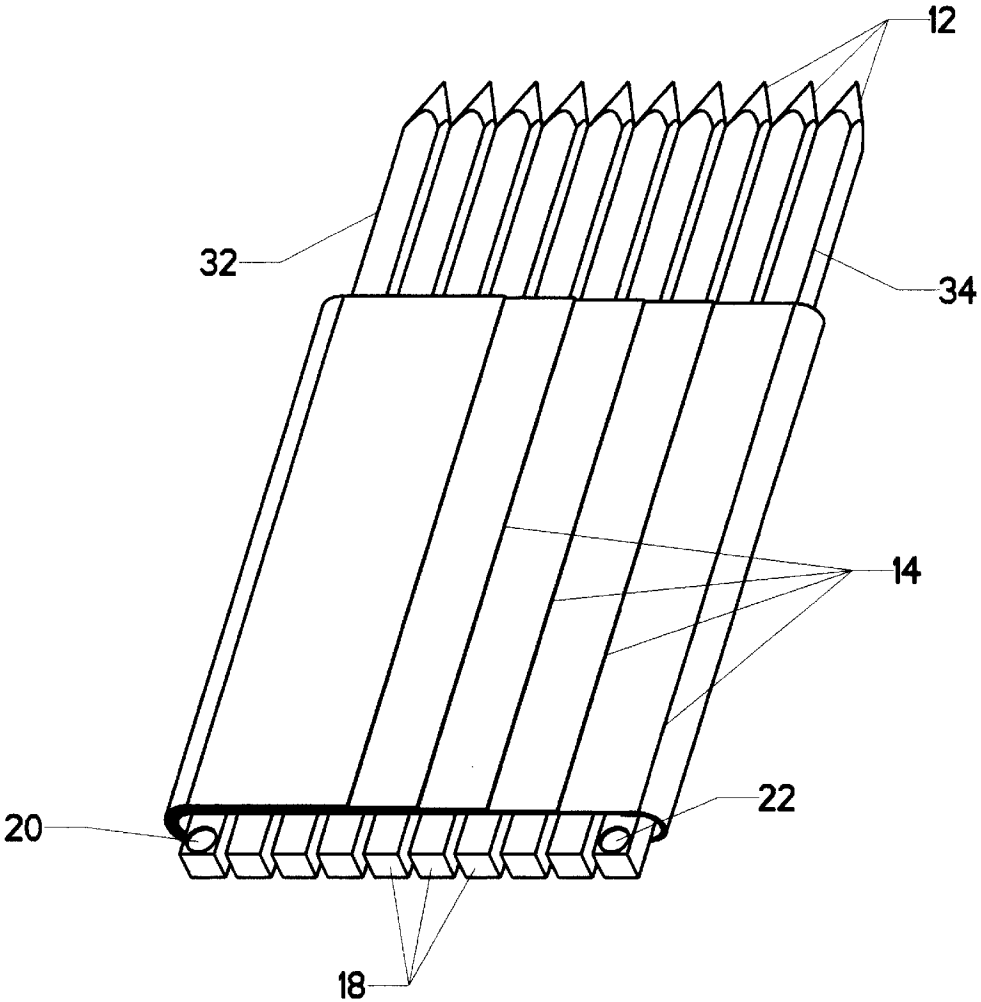
FIG. 8 is an isometric view, showing the wrapping of the loops around the stakes.

FIG. 8 shows stakes 12 with the plurality of loops 14 wrapped tightly around them. The reader will observe that each loop 14 has been pressed flat. As silt fabric 10 is thin and highly flexible, this operation does not place undue stress on the fabric.

Figure 9:
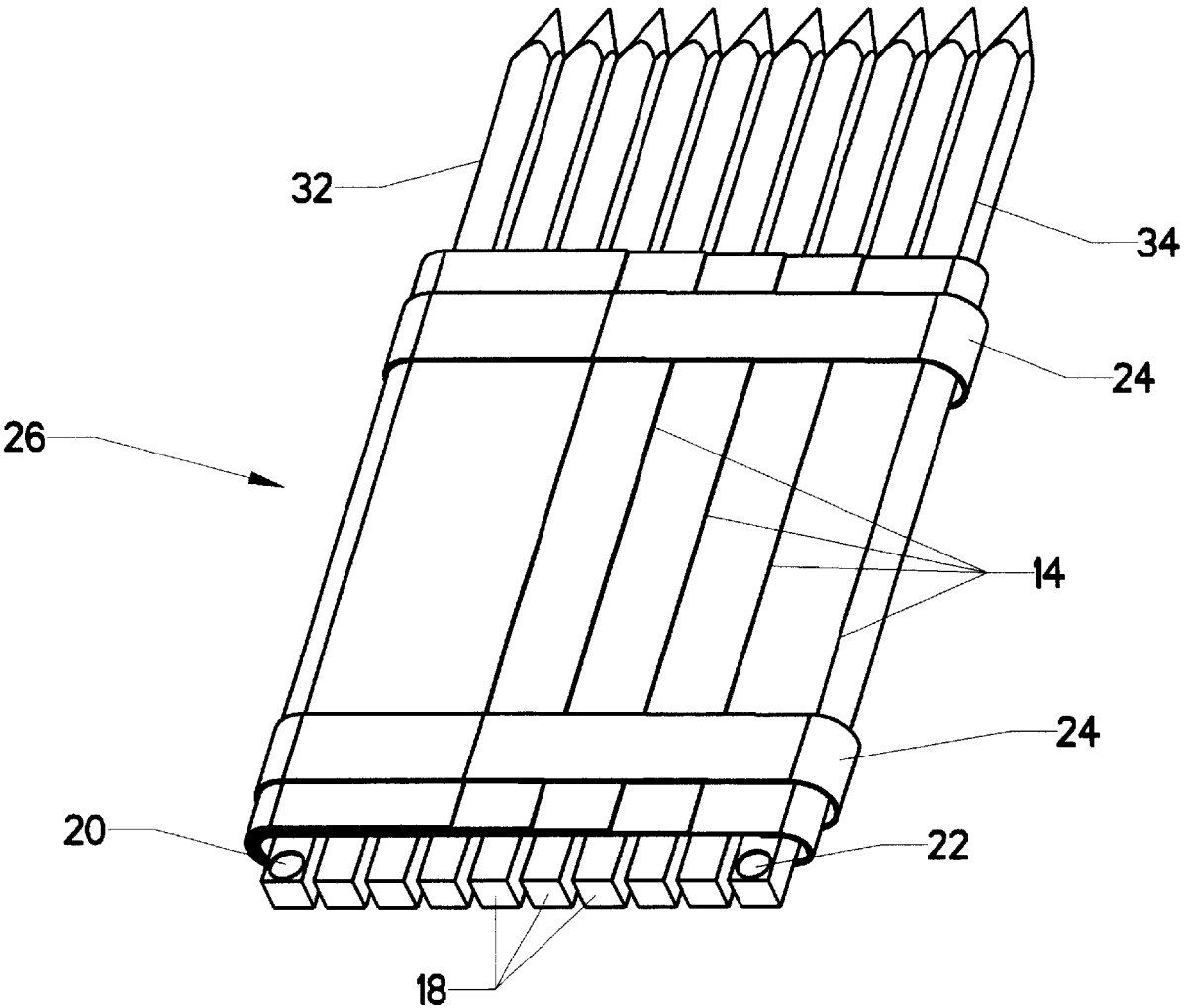
FIG. 9 is an isometric view, showing the strapping of the flat pack.

The assembly shown in FIG. 8 will not remain in its compact state without an additional step. FIG. 9 shows the addition of two securing straps 24. These can be metal bands, plastic bands, tape, or the like. Their function is to tightly bind the components together. Once bound, the result is a unitary structure referred to as flat pack 26. Flat pack 26 can be handled as a unit. Many flat packs 26 can be vertically stacked with very little waste of space. Flat packs 26 can also be placed on their narrow edges and stored in that fashion with very little waste of space.

The reader should appreciate that although stakes 12 have been illustrated as square, the method can be employed for stakes having many different cross-sections and characteristics.

When a user wants to pull the silt fence out of flat pack 26, it is important to know which end to start from. The user first removes securing straps 24. The user then pulls the portions of loops 14 resting over the top of flat pack 26 off to the left in FIG. 9. The user then pulls first stake 32 off to the left. The user then continues moving first stake 32 to the left. This action results in each successive loop 14 being unfurled out into a tight sheet and pulling the next stake 12 out of flatpack 26.

Those skilled in the art will realize that flat pack 26 can be made with many more stakes 12 than are shown in FIG. 9. In such a case, the user may not wish to use all of the flat pack. If so, the user simply stops pulling at the desired point and makes a transverse cut across silt fabric 10. He or she is able to pull off any desired amount without having to lift or move flat pack 26.

So long as the user starts with first stake 32, the unpacking operation will be smooth. Those skilled in the art will realize, however, that if the user starts pulling with last stake 34 (pulling it to the right as shown in FIG. 9), the operation will not be smooth. If the user begins pulling with last stake 34, he will have to pull the loops under flat pack 26 in order to start pulling last stake 34 free. This is difficult without moving the whole flat pack 26. The goal is to have flat pack 26 remain stationary while the user pulls off the desired length of silt fencing. Thus, it is important to be sure the user starts pulling on the correct end.

It is also important to ensure that flat pack is oriented as shown in FIG. 9; i.e., with the ends of loops 14 on its upper surface. If it is inverted, then the user will have difficulty pulling loops 14 out from beneath flat pack 26.

To ensure these goals, a color designation system is employed. First stake 32 has starting color patch 20 on its upper surface at its upper end (nearest the viewer in FIG. 9). Likewise, last stake 34 has ending color patch on its upper surface at its upper end. The colors employed should be easily distinguished—such as blue and yellow. These color cues will assist persons stacking flat packs 26. As an example, when placed on a truck, flat packs 26 should be placed with the color patches facing upward, and with first stake 32 toward the rear of the truck (or toward whichever side the silt fencing will be unloaded from).

The manufacturing operations described in FIGS. 3 through 9 could be carried out using a variety of mechanisms. The actual mechanisms employed are not significant to the present invention. However, it is important for the reader to understand that all of these operations can be carried out while stakes 12 are moving down a linear assembly line. In FIGS. 3 and 4, silt fabric 10 can be properly fed onto the plurality of stakes 12 as stakes 12 move transversely down an assembly line (with the stakes moving from right to left as shown in FIG. 4). Staples 16 can also be added while the line continues to move.

The bunching operations described in FIGS. 6 and 7 can be accomplished by transferring stakes 12 onto a decelerating conveyor. A desired length of silt fencing is then cut free and the wrapping of loops 14 (FIGS. 7 and 8) can be performed. There is no need to stop and start the moving assembly line, as in the prior art rolling approach.

Accordingly, the reader will appreciate that the proposed invention can readily create a silt fence stored in a convenient flat pack. The invention has further advantages in that it:

1. Can be carried out on a linear assembly line without intermittently stopping the linear motion;
2. Provides an improved method of packing and storing silt fence which does not waste storage space;
3. Enables the user to easily pull off a short section of silt fence without having to lift the entire pack; and
4. Enables the user to easily inventory a stack of silt fencing since the flat pack has little wasted space.

Although the preceding description contains significant detail, it should not be construed as limiting the scope of the invention but rather as providing illustrations of the preferred embodiment of the invention. As an example, many different methods could be employed to attach silt fabric 10 to stakes 12. As another example, mechanisms could be employed to align loops 14 in a single orientation, rather than using gravity to align them by suspending them below stakes 12. Thus, the scope of the invention should be fixed by the following claims, rather than by the examples given.

Having described my invention, I claim:

1. A method for manufacturing and storing a silt fence made from silt fabric attached to at least three stakes until a user is ready to deploy said silt fence, comprising:

a. attaching said silt fabric to said at least three stakes, by any conventional means, so that a loop of said silt fabric is formed between each of said at least three stakes, so as to form at least two loops;

b. bunching said at least three stakes closely together so that said at least three stakes all lie within one plane;

c. wrapping said loops of silt fabric around said at least three stakes; and d. removably binding said loops of silt fabric tightly against said at least three stakes to create a flat pack, so that said at least three stakes continue to lie within said one plane until said user removes said removable binding.

2. The method as recited in claim 1, further comprising applying a first distinct color to a first stake of said plurality of stakes, thereby indicating to said user that said first stake is the first to be pulled free from said flat pack.

3. The method as recited in claim 2, wherein said first distinct color is applied only to an upper surface of said first stake, thereby indicating to said user which side of said flat pack should be facing upward.

4. The method as recited in claim 2, further comprising applying a second distinct color to a last stake of said plurality of stakes, thereby indicating to said user that said last stake is the last to be pulled free from said flat pack.

5. The method as recited in claim 4, wherein said second distinct color is applied only to an upper surface of said last stake, thereby indicating to said user which side of said flat pack should be facing upward.

6. A silt fence flat pack, comprising:

a. a plurality of stakes, each having an upper surface, packed closely together and lying within a single plane;

b. a band of silt fabric, being fixedly attached to each of said plurality of stakes on said upper surface of said each of said plurality of stakes so as to divide said silt fabric into a plurality of evenly spaced portions, with said portions of said silt fabric lying between adjoining stakes being longer than the distance between said adjoining stakes to thereby form a plurality of folded loops of said silt fabric, and wherein said plurality of folded loops is wrapped tightly around said plurality of stakes; and c. at least one removable securing strap, affixed around said wrapped plurality of folded loops so as to lock said silt fabric and said plurality of stakes into an integral unit.

7. A device as recited in claim 6 wherein said plurality of stakes comprises a first stake, intended to be the first stake pulled free from said flat pack, and wherein said first stake further comprises a first distinct color patch placed thereon.

8. A device as recited in claim 7, wherein said plurality of stakes comprises a last stake, intended to be the last stake pulled free from said flat pack, and wherein said last stake further comprises a second distinct color patch placed thereon.

* * * * *